US006422344B1

(12) United States Patent
Cox

(10) Patent No.: US 6,422,344 B1
(45) Date of Patent: Jul. 23, 2002

(54) FOLDING STEP LADDER

(76) Inventor: John J. Cox, 807 South St., Piqua, OH (US) 45356

( * ) Notice: Subject to any disclaimer, the term of this patent is extended or adjusted under 35 U.S.C. 154(b) by 0 days.

(21) Appl. No.: 09/665,011

(22) Filed: Sep. 19, 2000

(51) Int. Cl.[7] ..... E06C 1/00; E04G 5/02
(52) U.S. Cl. ..... 182/163; 182/107; 182/25
(58) Field of Search ..... 182/150, 163, 182/214, 107, 127, 164, 95, 206, 22–26

(56) References Cited

U.S. PATENT DOCUMENTS

| | | | | | |
|---|---|---|---|---|---|
| 257,168 | A | * | 5/1882 | Lape | 182/163 |
| 341,284 | A | * | 5/1886 | Sharp | 182/25 |
| 1,973,774 | A | * | 9/1934 | Pflugradt | 182/163 X |
| 3,474,881 | A | * | 10/1969 | Green | 182/24 |
| 3,912,043 | A | | 10/1975 | Brannan | |
| 4,483,415 | A | * | 11/1984 | Disston et al. | 182/22 |
| D300,365 | S | | 3/1989 | Wallick, Jr. et al. | |
| 4,852,691 | A | * | 8/1989 | Bruno | 182/46 X |
| D324,019 | S | | 2/1992 | Bailey | |
| D376,784 | S | | 12/1996 | Miller | |
| D394,628 | S | | 5/1998 | Wentzel | |
| D425,209 | S | | 5/2000 | Cox | |
| 6,116,378 | A | * | 9/2000 | Barrow | 182/127 |

* cited by examiner

*Primary Examiner*—Daniel P. Stodola
*Assistant Examiner*—Hugh B. Thompson
(74) *Attorney, Agent, or Firm*—Jacox, Meckstroth & Jenkins

(57) ABSTRACT

First and second ladder sections are each molded of a rigid plastics material, and each ladder section includes parallel spaced elongated leg portions integrally connected by two parallel spaced step portions. The ladder sections are pivotally connected by pins extending through overlapping laterally projecting ears and move between a collapsed position with the ladder sections adjacent and an extended aligned position where the second ladder section is supported by the first ladder section. The leg portions of the second ladder section define longitudinally extending cavities which receive corresponding elongated arms pivotal to generally horizontal positions adapted for seating on a motor vehicle tire. The arms also releasably connect with the leg portions of the first ladder section to position the ladder sections in the form of a short A-shaped step ladder.

8 Claims, 3 Drawing Sheets

97
76
20
95
30
81
79
74
72
38
91
59
32
36
56
28
41
43
42
61
87
86
83
57
52
48
46
53
49
66

FOLDING STEP LADDER

BACKGROUND OF THE INVENTION

When cleaning the front windshield or windshields of large motor vehicles such as trucks, buses and recreational vehicles, it is usually impossible for a person to stand on the ground and reach the front windshield for cleaning without using a cleaning tool having an extended handle. When it is desirable to reach the windshield for hand scrubbing, washing and cleaning, it is common for the operator to stand on a front tire or on a front fender which is sometimes not easily accessible or may be slippery due to water, ice and/or snow.

Different forms of step devices have been constructed or proposed for mounting on the tire of a motor vehicle to facilitate working on the engine of the vehicle or cleaning the vehicle, such as the devices, for example, disclosed in U.S. Design Pat. Nos. 324,019, 376,784 and 394,628. However, such step devices are limited in their uses and are not helpful for cleaning of the windshields of a large bus or truck.

SUMMARY OF THE INVENTION

The present invention is directed to an improved folding step ladder which has multiple uses and is ideally suited for use with large trucks, buses, recreational vehicles (RVs), and the like, to assist in cleaning the front windshields of the vehicles. The step ladder of the invention is also adapted for use with smaller RVs and truck campers to assist the operator in reaching higher places on the vehicle. The step ladder of the invention folds in half for compact storage, is constructed of a durable and rigid plastics material, and incorporates retractable arms for seating on the top of a motor vehicle tire or for making a short stable step ladder.

In accordance with one embodiment of the invention, a first ladder section and a second ladder section, of generally the same shape and size, are each molded of a rigid plastics material with each ladder section having parallel spaced elongated leg portions integrally connected by two parallel spaced step portions. The leg and step portions have channel-like cross-sectional configurations and are reinforced by internal walls. Adjacent ends of the ladder sections have laterally projecting overlapping ears for receiving pivot pins which provide for pivoting the ladder sections between a folded collapsed position and a fully extended position where the ladder sections are in longitudinal alignment. The leg portions of the second or upper ladder section define longitudinally extending cavities which receive pivotally connected arms moveable to horizontal positions for seating on a motor vehicle tire. The arms may also be releasably connected to the leg portions of the first ladder section to provide a short A-shaped step ladder.

Other features and advantages of the invention will be apparent from the following description, the accompanying drawings and the appended claims.

DESCRIPTION OF THE PREFERRED EMBODIMENT

Figure 1:
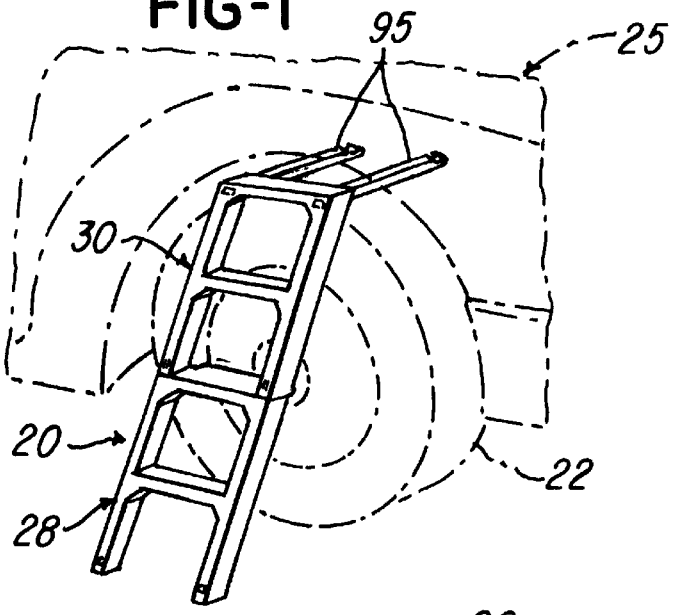
FIG. 1 is a perspective view of a folding step ladder constructed in accordance with the invention and illustrating its use on a front tire of a large truck.

FIG. 1 illustrates a folding step ladder 20 constructed in accordance with the invention and in an extended position for mounting or seating on a tire 22 of a large motor vehicle 25 such as the tractor or truck for a semitrailer or a bus to facilitate washing and cleaning the front windshield of the truck or bus. The step ladder 20 includes a first or lower ladder section 28 and a second or upper ladder section 30 each has a height of about two feet and is molded of a rigid plastics material to provide a light weight and durable ladder which will not rust or corrode. The first ladder section 28 included parallel spaced elongated leg portions 32 which are integrally connected by a lower step portion 36 and an upper step portion 38 which has a depth greater than the step portion 36. Each of the leg portions 32 and step portions 36 and 38 has a channel-shaped cross-sectional configuration with the leg portions 32 having parallel spaced side walls 41 and 42 integrally connected by a front wall 43.

Figures 3, 4:
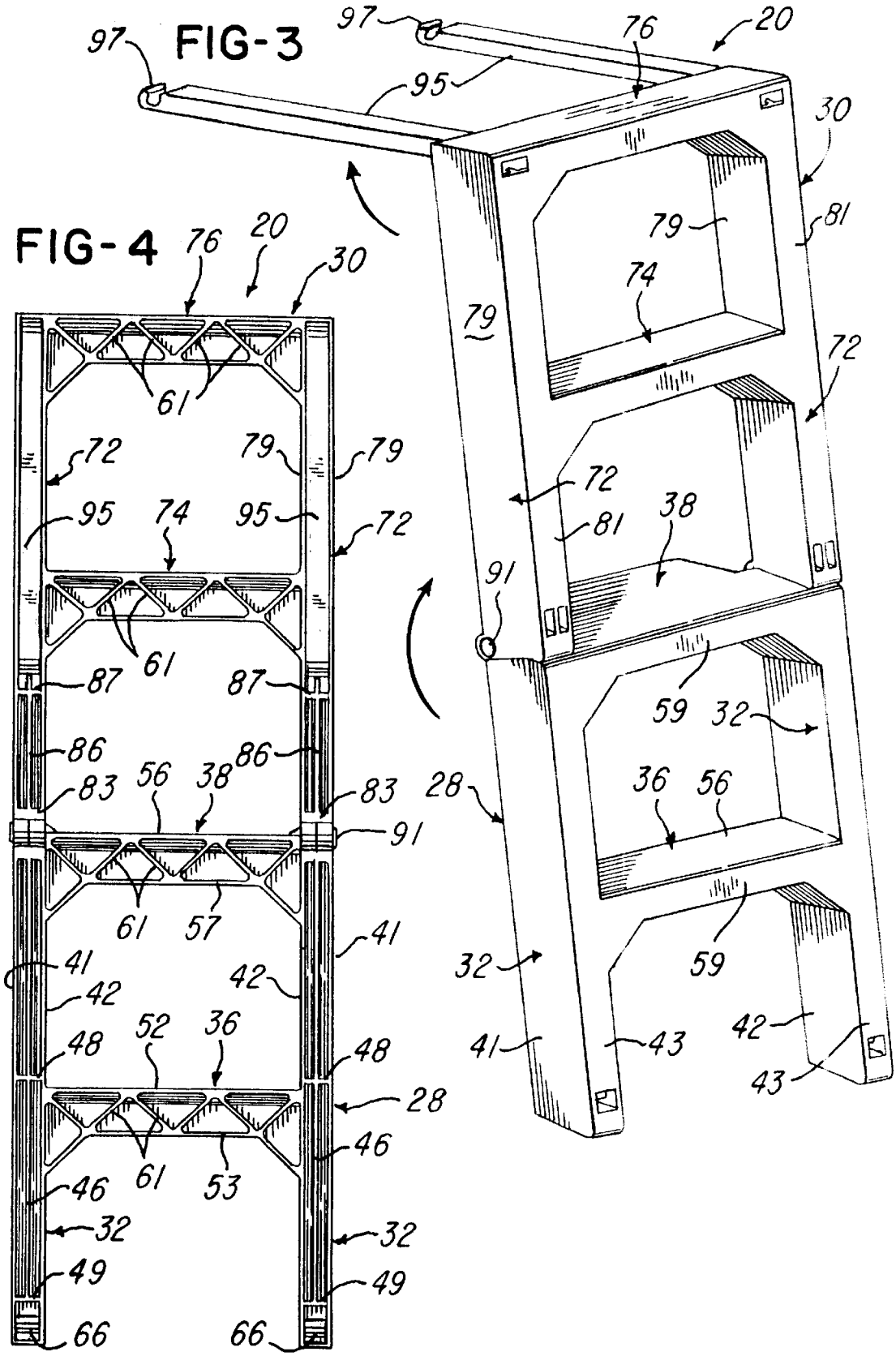
FIG. 3 is a larger perspective view of the folding step ladder shown in FIG. 1 and with support arms extended.
FIG. 4 is a rear view of the extended step ladder shown in FIG. 3, with the support arms retracted.

As shown in FIG. 4, each of the leg portions 32 also has a longitudinally extending intermediate reinforcing wall 46 which is spaced between the side walls 41 and 42 and intersects laterally extending reinforcing walls 48 and 49. As also shown in FIG. 4, each of the step portions 36 and 38 has generally parallel spaced upper and lower walls 52 and 53 and 56 and 57, respectively, which are integrally connected by corresponding front walls 59. The top and bottom walls of each of the step portions 36 and 38 are also reinforced by a series of inclined walls 61 each of which forms an acute angle with respect to the top and bottom walls. The upper ends of the leg portions 32 are provided with a pair of integrally molded and laterally projecting ears 63 which have aligned holes. The lower ends of the leg portions 32 have integrally molded cross pins 66 (FIGS. 4 and 6) which integrally connect the side walls 41 and 42 of the leg portion 32.

Figure 2:
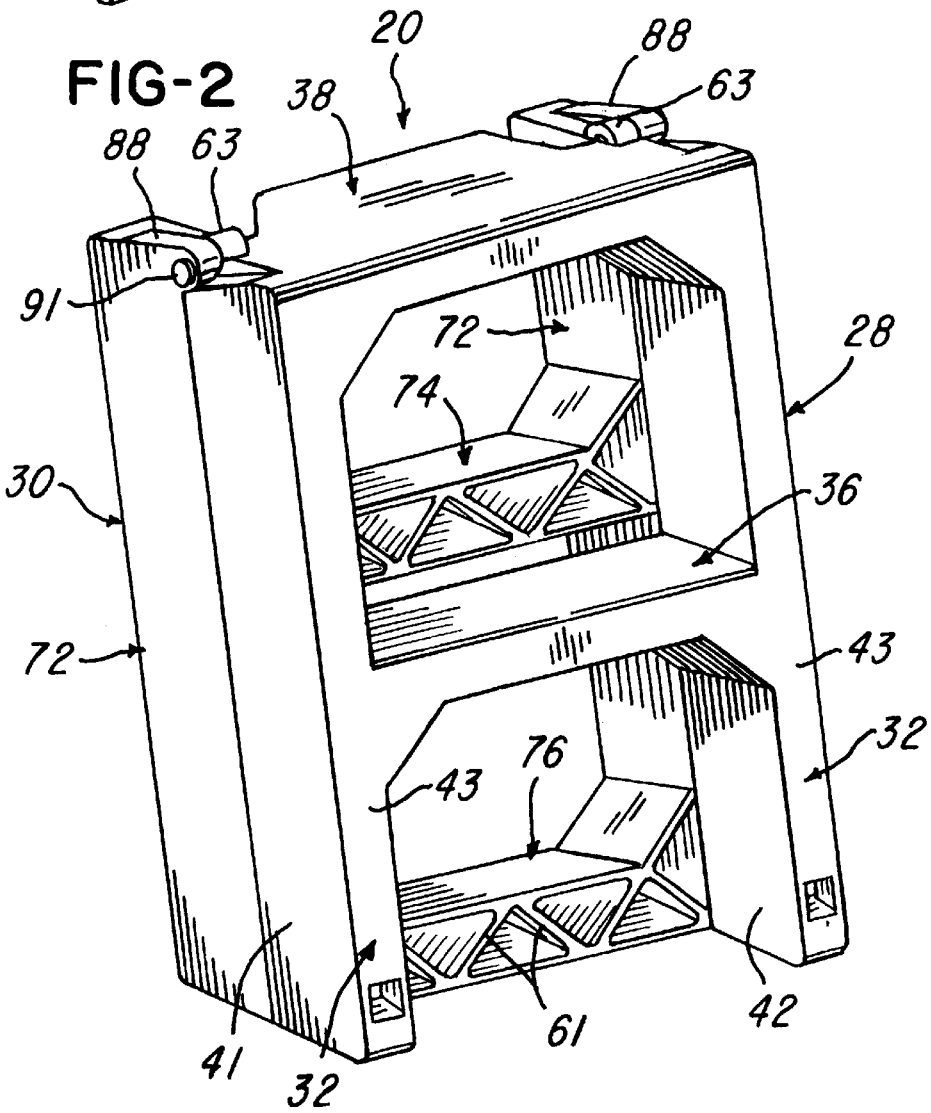
FIG. 2 is a perspective view of the step ladder shown in FIG. 1 and folded in half to its collapsed storage position.
Figure 5:
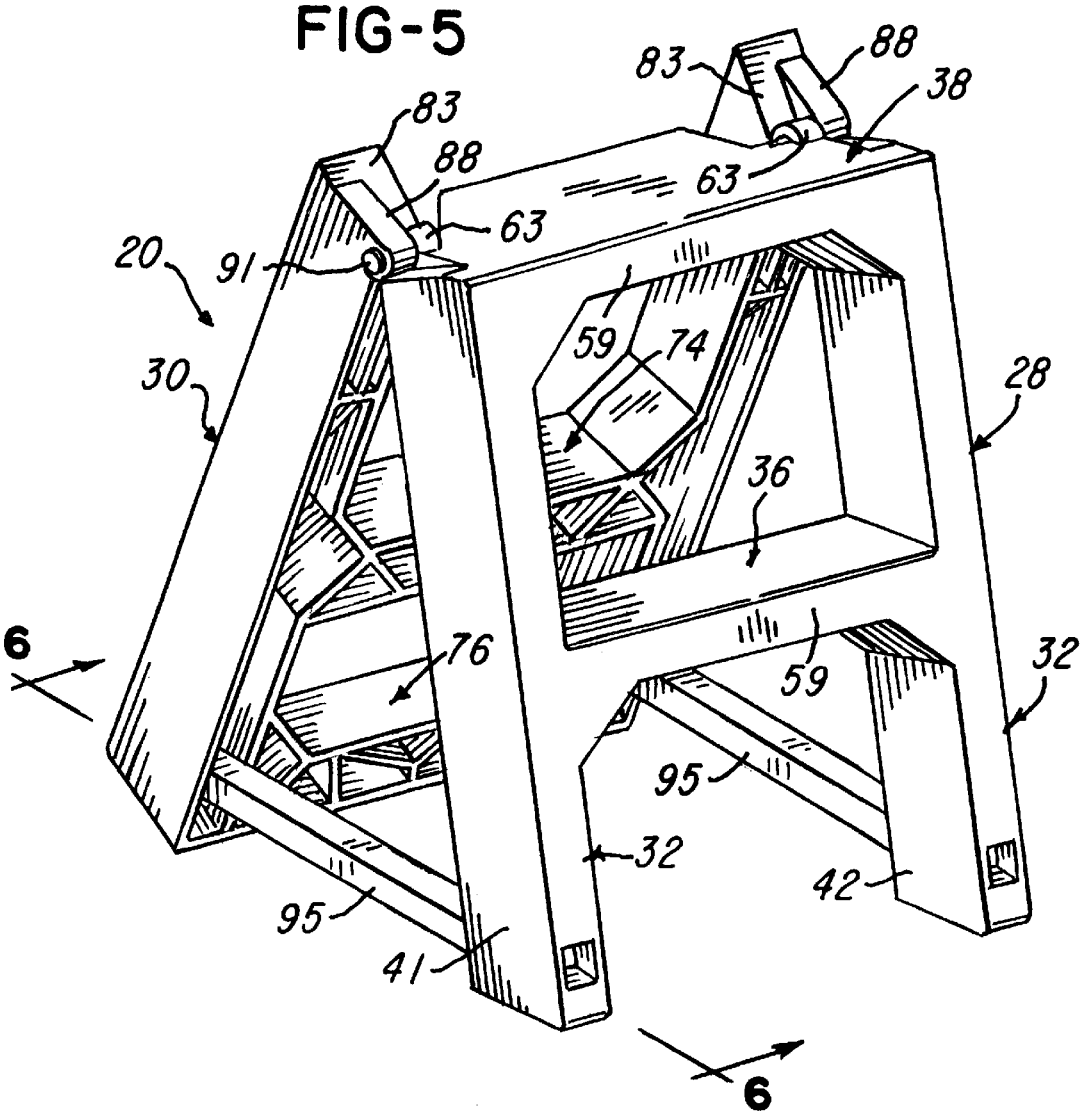
FIG. 5 is a perspective view of the ladder shown in FIGS. 1–4 and in the position of a short step ladder having an "A" configuration.

The second or upper ladder section 30 is constructed and molded in a manner similar to that of the lower ladder section 28 and includes parallel spaced leg portions 72 which are integrally connected by a lower step portion 74 and an upper step portion 76. Each of the leg portions 72 and step portions 74 and 76 also have a channel shaped cross-sectional configuration, with each leg portion 72 having parallel spaced side walls 79 integrally connected by a front wall 81 and an end wall 83. The upper and lower walls of the step portions 74 and 76 are also reinforced by inclined walls 61. The lower portion of each leg portion 72 is reinforced by an intermediate wall 86 which is spaced parallel between the side walls 79 and by a laterally extending wall 87. Referring to FIGS. 2 and 5, the end walls 83 of the leg portions 72 for the second ladder section 30 are molded with corresponding laterally projecting ears 88 which have holes aligned with the holes within the ears 63 for receiving a set of pivot pins 91 having split tapered inner end portions which snap-fit into the aligned sets of holes.

Figure 6:
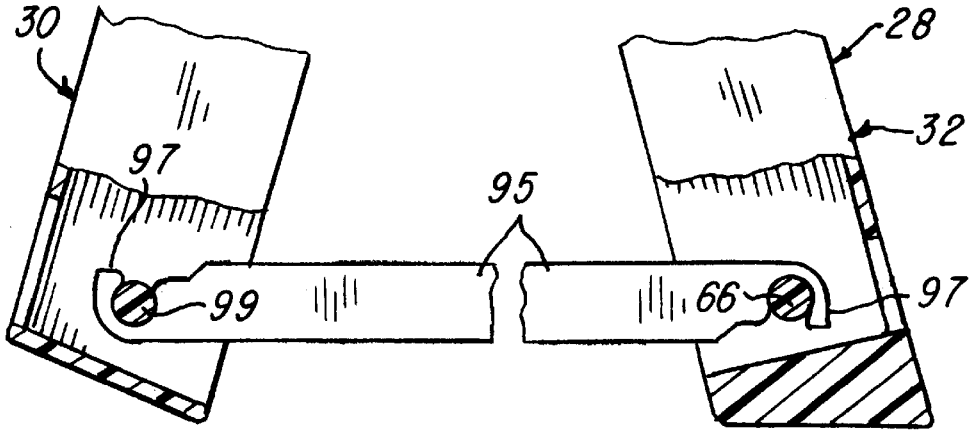
FIG. 6 is a fragmentary section taken generally on the line 6—6 of FIG. 5.

The leg portions 72 of the second or upper ladder section 30 define elongated chambers or cavities which receive a corresponding pair of elongated arms 95 (FIG. 4). Each of the arms 95 is molded of the same rigid plastics material as the ladder sections and has a channel-shape cross-sectional configuration with longitudinally extending and laterally extending internal reinforcing walls (not shown). Referring to FIG. 6, each of the arms 95 has hook-shaped opposite end portions 97 which snap-fit onto the cross pin 66 within the corresponding leg portion 32 and onto a similar cross pin 99 (FIG. 6) integrally molded with the side walls 79 of the corresponding leg portion 72 of the second ladder section 30. As shown in FIGS. 5 and 6, the arms 95 lock the ladder sections 28 and 30 together in the form of a short two step ladder having the general shape of an A-frame with a height of about two feet.

From the drawings and the above description, it is apparent that a step ladder constructed in accordance with the present invention provides desirable features and advantages. For example, the construction of each ladder section 28 and 30 of molded rigid plastics material provides for a high strength and light weight ladder while also providing step portions having substantial depth to provide the user with stability when standing on the step portions. In the collapsed position of the ladder sections 28 and 30 (FIG. 2), the step ladder assembly 20 is compact for storage in a rectangular storage box. When the ladder sections 28 and 30 are in their extended position (FIGS. 1, 3 and 4), the bottom ends of the leg portions 72 of the second ladder section 30 seat upon and are supported by the upper ends of the aligned leg portions 32 of the lower or first ladder section 28 to form a rigid extension ladder (FIG. 3). In addition, the retractable arms 95 provide for conveniently and securely positioning the ladder assembly 20 on a motor vehicle tire (FIG. 1) to aid in working on the vehicle body or engine or cleaning the front windshield of the vehicle. As also illustrated in FIGS. 5 and 6, the pivotable arms 95 may be used to connect the lower end portions of the ladder sections 28 and 30 to provide a rigid multi-purpose short step ladder having a height of about two feet.

While the form of step ladder herein described constitutes a preferred embodiment of the invention, it is to be understood that the invention is not limited to this precise form of ladder, and that changes may be made therein without departing from the scope and spirit of the invention as defined in the appended claims.

What is claimed is:

1. A step ladder assembly comprising first and second ladder sections each of one-piece rigid plastics material, each of said ladder sections having two generally parallel step portions integrally connected by only two generally parallel spaced elongated leg portions, each of said leg portions and each of said step portions having a channel-shape cross-sectional configuration and defining cavities facing in the same direction, pivot connections pivotally connecting adjacent said leg portions of said first and second ladder sections and providing for moving said ladder sections between a collapsed position with said leg portions of said ladder sections laterally adjacent and an extended position with said leg portions of said ladder sections longitudinally aligned, said leg portions of said first and second ladder sections defining longitudinally extending said cavities with said cavities of said first ladder section opposing the corresponding said cavities of said second ladder section when said ladder sections are in said collapsed position, said leg portions of said second ladder section are supported by the aligned said leg portions of said first ladder section when said ladder sections are in said extended position, and a pair of elongated arms pivotally connected to said leg portions of said second ladder section and moveable between retracted position within corresponding said cavities of said leg portions of said second ladder section and outwardly projecting substantially parallel cantilever positions.

2. A ladder assembly as defined in claim 1 wherein said leg portions of said first ladder section have connectors within said cavities for releasably connecting with outer end portions of said arms extending from said second ladder section for selectively positioning said ladder sections in the shape of an A-frame with both of said ladder sections inclined relative to a supporting surface.

3. A ladder assembly as defined in claim 2 wherein said connectors on said leg portions of said first ladder section comprise cross pins within said cavities of said leg portions of said first ladder section, and said arms have hooked-shaped outer tip portions forming a snap-fit connection with said cross pins.

4. A ladder assembly as defined in claim 1 wherein each of said step portions of each of said ladder sections includes an upper wall and a lower wall integrally are integrally connected by a plurality of parallel spaced reinforcing walls inclined at acute angles with said upper and lower walls of said step portion.

5. A ladder assembly as defined in claim 1 wherein each of said leg portions of said first ladder section has longitudinally extending and parallel spaced side walls integrally connected by a front wall, and a longitudinally extending intermediate reinforcing wall spaced between said side walls and integrally connected to said front wall.

6. A ladder assembly as defined in claim 1 wherein said step portions of said first and second ladder sections have substantially flat top step surfaces when said ladder sections are in said extended position.

7. A ladder assembly as defined in claim 1 wherein said leg portions of each said ladder section have a length of about two feet.

8. A ladder assembly as defined in claim 1 wherein said leg portions of said ladder sections have laterally projecting overlapping and interfitting ears, a pair of aligned pivot pins extending through holes within said ears to form said pivot connections, and said ears have engaging surfaces when said ladder sections are in said extended position.

* * * * *

UNITED STATES PATENT AND TRADEMARK OFFICE

CERTIFICATE OF CORRECTION

PATENT NO. : 6,422,344 B1
DATED : July 23, 2002
INVENTOR(S) : John J. Cox

It is certified that error appears in the above-identified patent and that said Letters Patent is hereby corrected as shown below:

Column 4,
Line 31, after "integrally" (first occurrence) insert -- connected by a front wall, and said upper and lower walls of each said step portion --.

Signed and Sealed this

Nineteenth Day of November, 2002

*Attest:*

*Attesting Officer*

JAMES E. ROGAN
*Director of the United States Patent and Trademark Office*